US011103029B2

(12) United States Patent
Verfl et al.

(10) Patent No.: US 11,103,029 B2
(45) Date of Patent: Aug. 31, 2021

(54) TONGUELESS UPPER WITH LACING SYSTEM

(71) Applicant: Cole Haan LLC, New York, NY (US)

(72) Inventors: Mattias Verfl, Greenland, NH (US); Pablo Chao, Greenland, NH (US)

(73) Assignee: COLE HAAN LLC, Greenland, NC (US)

( * ) Notice: Subject to any disclaimer, the term of this patent is extended or adjusted under 35 U.S.C. 154(b) by 184 days.

(21) Appl. No.: 16/208,286

(22) Filed: Dec. 3, 2018

(65) Prior Publication Data

US 2020/0170349 A1 Jun. 4, 2020

(51) Int. Cl.

| | |
|---|---|
| ***A43B 23/04*** | (2006.01) |
| ***A43B 1/04*** | (2006.01) |
| ***A43C 5/00*** | (2006.01) |
| ***A43C 1/04*** | (2006.01) |
| ***A43B 23/02*** | (2006.01) |

(52) U.S. Cl.

CPC ..... *A43B 23/042* (2013.01); *A43B 1/04* (2013.01); *A43B 23/0245* (2013.01); *A43C 1/04* (2013.01); *A43C 5/00* (2013.01)

(58) Field of Classification Search

CPC .... A43C 1/00; A43C 5/00; A43C 1/04; A43C 1/003; A43B 1/04; A43B 23/042; A43B 23/0245

USPC ..... 36/49, 50.1, 54, 48; 24/575.1, 68 SK, 24/713.6

See application file for complete search history.

(56) References Cited

U.S. PATENT DOCUMENTS

| | | | | |
|---|---|---|---|---|
| 2,147,197 | A * | 2/1939 | Glidden | A43B 1/02 36/9 R |
| 4,817,303 | A * | 4/1989 | Selbiger | A43C 1/00 36/50.1 |
| 6,662,469 | B2 | 12/2003 | Belley et al. | |
| 2005/0193592 | A1* | 9/2005 | Dua | A43B 23/042 36/45 |
| 2010/0251491 | A1 | 10/2010 | Dojan et al. | |
| 2011/0088285 | A1 | 4/2011 | Dojan et al. | |
| 2014/0130372 | A1 | 5/2014 | Aveni et al. | |
| 2014/0137434 | A1* | 5/2014 | Craig | A43B 23/0245 36/54 |
| 2014/0373389 | A1 | 12/2014 | Bruce | |
| 2015/0059209 | A1* | 3/2015 | Dekovic | A43B 23/0205 36/84 |
| 2015/0216254 | A1 | 8/2015 | Podhajny | |
| 2016/0331083 | A1* | 11/2016 | Uesato | A43B 23/0265 |

OTHER PUBLICATIONS

Nordstrom "Odyssey React Running Shoe", <https://shop.nordstrom.com/s/nike-odyssey-react-running-shoe-women/5153952?origin=keywordsearch-personalizedsort&breadcrumb=Home%2FAll%20Results&color=light%20silver%2F%20sail%2F%20mica%20green>, accessed Nov. 29, 2018.

* cited by examiner

*Primary Examiner* — Nathan E Durham
*Assistant Examiner* — Abby M Spatz
(74) *Attorney, Agent, or Firm* — Thompson Coburn LLP

(57) ABSTRACT

A knitted shoe upper includes a unitary one-piece knitted element with an integrated tongue. The upper also includes a lacing system including a medial side eyestay and a lateral side eyestay. The medial side eyestay includes a plurality of medial side eyelets, and the lateral side eyestay includes a plurality of lateral side eyelets. The medial and lateral eyestays are configured such that a single shoelace can be placed through each of the plurality of lateral and medial side eyelets without extending through the knitted element.

14 Claims, 7 Drawing Sheets

TONGUELESS UPPER WITH LACING SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable.

BACKGROUND

Field

This disclosure pertains to a shoe lacing system.

SUMMARY

One aspect of the disclosure pertains to a shoe including a knitted shoe upper. The knitted shoe upper includes a knitted element. The knitted element is formed of a unitary one-piece construction during a knitting process on a knitting machine. The knitted element includes a knitted upper tongue region, a knitted upper heel region, a knitted upper lateral midfoot region, a knitted upper medial midfoot region, a knitted upper metatarsal region, a knitted upper lateral ball region, a knitted upper medial ball region, and a knitted upper toe region. The upper metatarsal region includes a knitted upper lateral metatarsal region and a knitted upper medial metatarsal region. The upper has a knitted upper lateral side region and a knitted upper medial side region. The upper lateral side region includes the upper lateral midfoot region, the upper lateral metatarsal region and the upper lateral ball region, and the upper medial side region includes the upper medial midfoot region, the upper medial metatarsal region and the upper medial ball region. The upper toe region is seamlessly knitted with the upper medial and lateral ball regions during the knitting process, the upper medial and lateral ball regions is seamlessly knitted with the upper metatarsal region during the knitting process, and the upper metatarsal region is seamlessly knitted with the upper lateral and medial midfoot regions during the knitting process. The knitted upper tongue region is seamlessly knitted with the knitted upper toe region, the knitted upper tongue region is seamlessly knitted with the knitted upper lateral side region, the knitted upper tongue region is seamlessly knitted with the knitted upper medial side region, and the upper knitted tongue region is seamlessly knitted with the knitted upper lateral and medial side regions such that the knitted element is of a tongueless construction. The knitted tongue region is integrated with the upper lateral and medial side regions. The shoe also includes a lacing system including a medial side eyestay and a lateral side eyestay. The medial side eyestay includes a plurality of medial side eyelets, and the lateral side eyestay includes a plurality of lateral side eyelets. The medial and lateral eyestays are configured such that a single shoelace can be placed through each of the plurality of lateral and medial side eyelets without extending through the knitted element.

Another aspect of the disclosure pertains to a shoe including a knitted shoe upper. The knitted shoe upper includes a knitted element. The knitted element is formed of a unitary one-piece construction during a knitting process on a knitting machine. The knitted element includes a knitted upper tongue region, a knitted upper heel region, a knitted upper lateral midfoot region, a knitted upper medial midfoot region, a knitted upper metatarsal region, a knitted upper lateral ball region, a knitted upper medial ball region, and a knitted upper toe region. The upper metatarsal region includes a knitted upper lateral metatarsal region and a knitted upper medial metatarsal region. The upper has a knitted upper lateral side region and a knitted upper medial side region. The upper lateral side region includes the upper lateral midfoot region, the upper lateral metatarsal region and the upper lateral ball region, and the upper medial side region includes the upper medial midfoot region, the upper medial metatarsal region and the upper medial ball region. The upper toe region is seamlessly knitted with the upper medial and lateral ball regions during the knitting process, the upper medial and lateral ball regions is seamlessly knitted with the upper metatarsal region during the knitting process, and the upper metatarsal region is seamlessly knitted with the upper lateral and medial midfoot regions during the knitting process. The knitted upper tongue region is seamlessly knitted with the knitted upper toe region, the knitted upper tongue region is seamlessly knitted with the knitted upper lateral side region, the knitted upper tongue region is seamlessly knitted with the knitted upper medial side region, and the upper knitted tongue region is seamlessly knitted with the knitted upper lateral and medial side regions such that the knitted element is of a tongueless construction. The knitted tongue region is integrated with the upper lateral and medial side regions. The shoe also includes a lacing system including a medial side eyestay and a lateral side eyestay. The medial side eyestay includes a plurality of medial side eyelets, and the lateral side eyestay includes a plurality of lateral side eyelets. The medial side eyestay extends transversely between an inner edge and an outer edge with the inner edge being closer to a longitudinal centerline of the knitted upper than the outer edge. The medial side eyestay has an inner edge margin adjacent the inner edge and has an outer edge margin adjacent the outer edge. The lateral side eyestay extends transversely between an inner edge and an outer edge with the inner edge being closer to a longitudinal centerline of the knitted upper than the outer edge. The lateral side eyestay has an inner edge margin adjacent the inner edge and has an outer edge margin adjacent the outer edge. The medial and lateral eyestays collectively do not overlie the entirety of the knitted upper tongue region. The medial eyestay is stitched to the knitted element in the outer edge margin of the medial eyestay, and the lateral eyestay is stitched to the knitted element in the outer edge margin of the lateral eyestay. The shoe further includes a shoelace. The shoelace is threaded through the plurality of lateral side eyelets and the plurality of medial side eyelets such that the shoelace overlies the knitted element without passing through the knitted element.

Another aspect of the disclosure pertains to a shoe upper including an upper tongue region, an upper heel region, an upper lateral midfoot region, an upper medial midfoot region, an upper metatarsal region, an upper lateral ball region, an upper medial ball region, and an upper toe region. The upper metatarsal region includes an upper lateral metatarsal region and an upper medial metatarsal region. The upper has an upper lateral side region and an upper medial side region. The upper lateral side region includes the upper lateral midfoot region, the upper lateral metatarsal region, and the upper lateral ball region. The upper medial side region includes the upper medial midfoot region, the upper medial metatarsal region, and the upper medial ball region. The upper is of a tongueless construction such that the upper tongue region is integrated with the upper lateral and medial side regions. The shoe also includes a lacing system including a medial side eyestay and a lateral side eyestay. The medial side eyestay includes a plurality of medial side eyelets, and the lateral side eyestay includes a plurality of lateral side eyelets. The medial side and lateral side eyestays are configured such that a single shoelace can be placed through each of the plurality of lateral and medial side eyelets without extending through the upper.

Further features and advantages of the present disclosure, as well as the operation of the embodiments described herein, are described in detail below with reference to the accompanying drawings.

Figure 1:
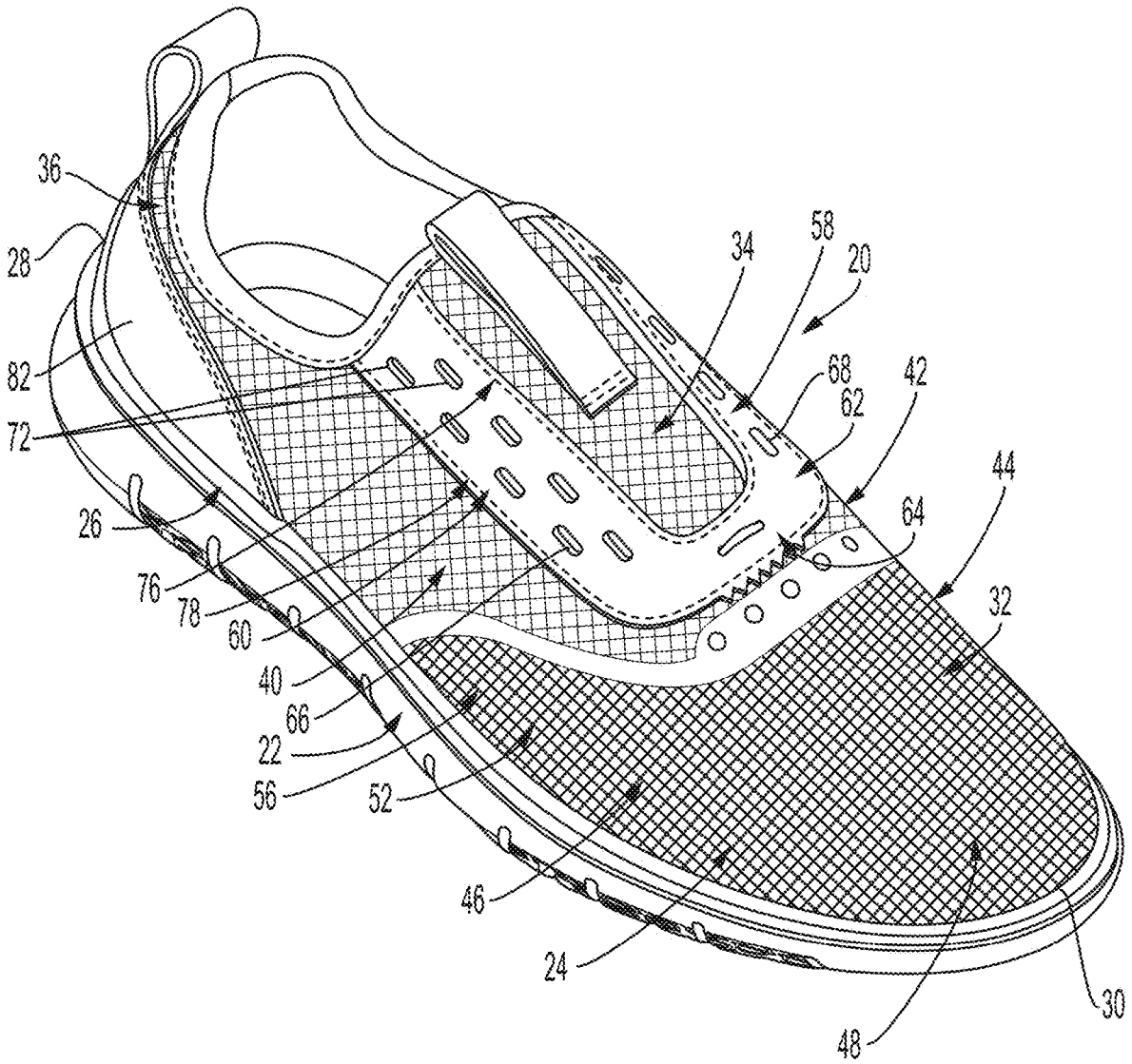
FIG. 1 is a medial perspective view of an exemplary embodiment of a shoe of the present disclosure.

Reference numerals in the written specification and in the drawing figures indicate corresponding items.

DETAILED DESCRIPTION

Figure 2:
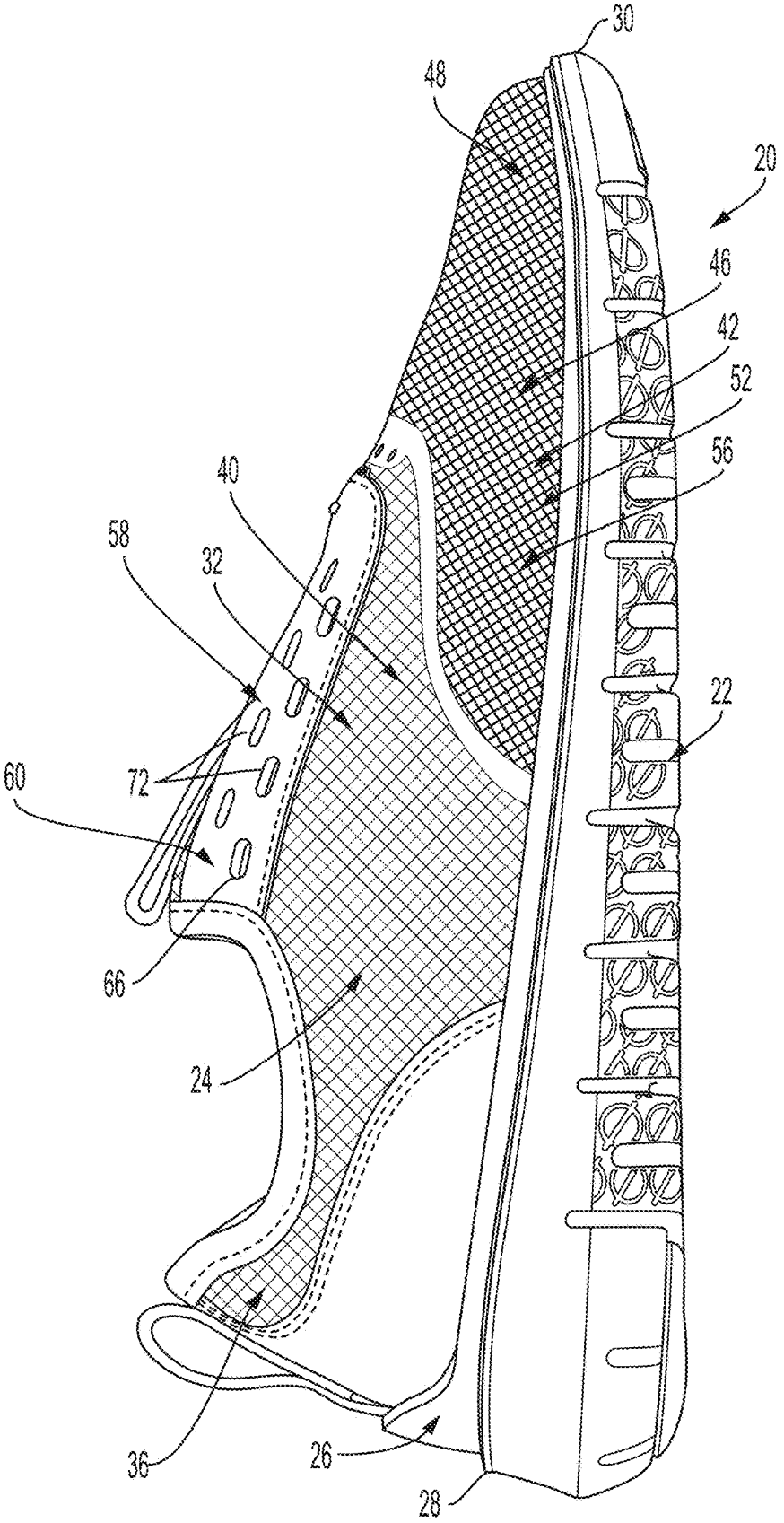
FIG. 2 is a medial side view of the shoe shown in FIG. 1.
Figure 3:
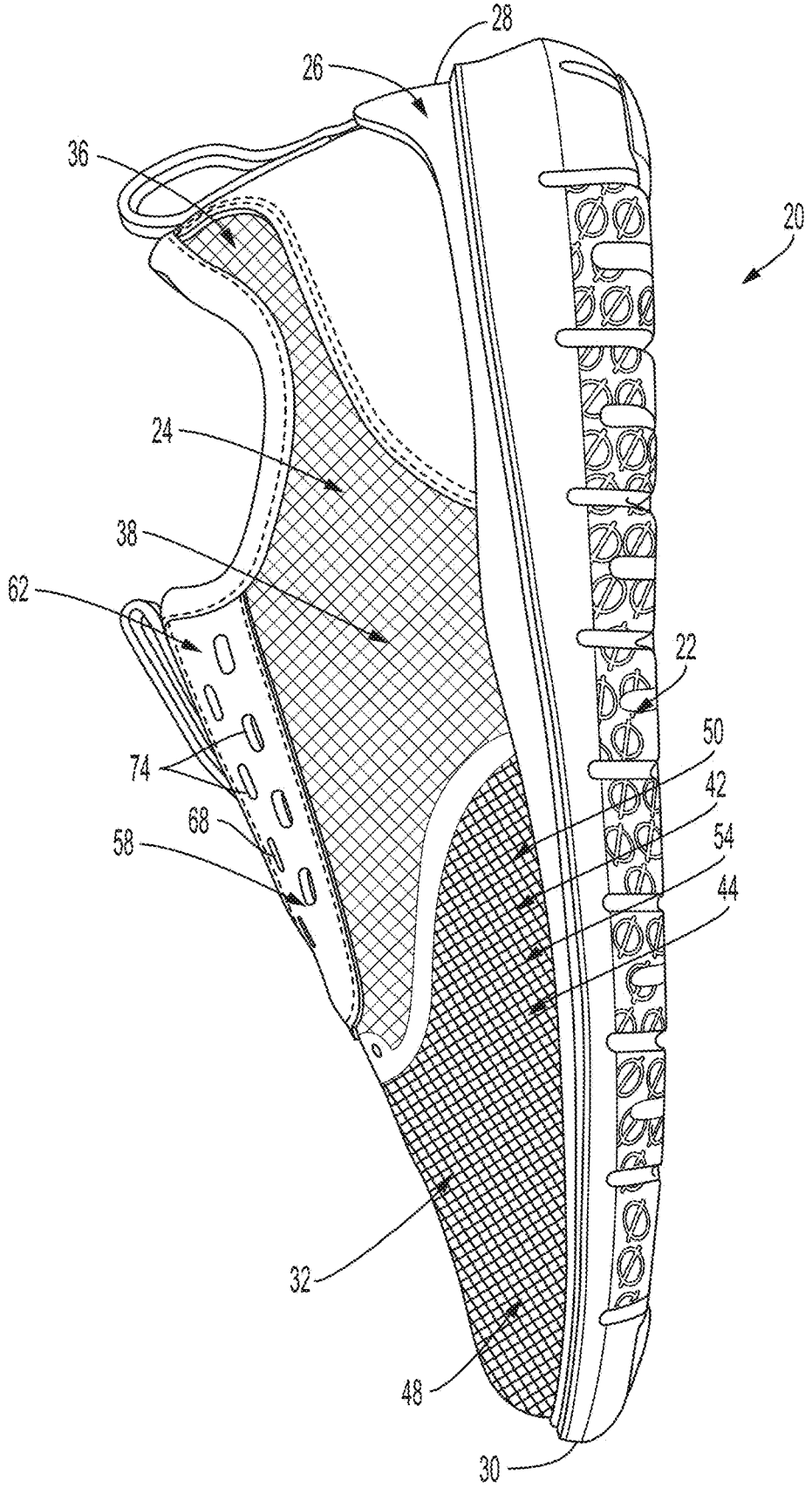
FIG. 3 is a lateral side view of the outsole shoe shown in FIG. 1.
Figure 4:
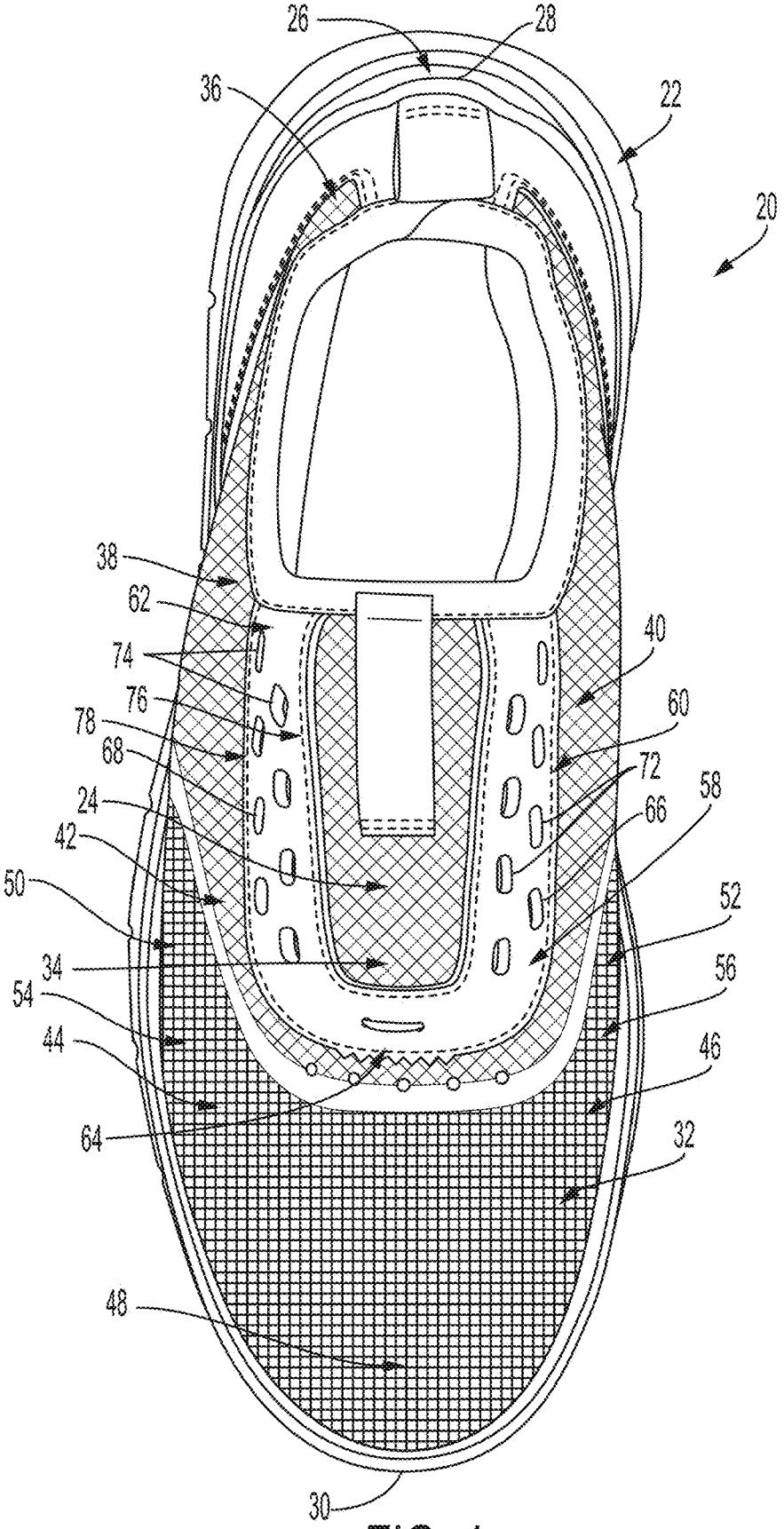
FIG. 4 is a top view of the shoe shown in FIG. 1.
Figure 5:
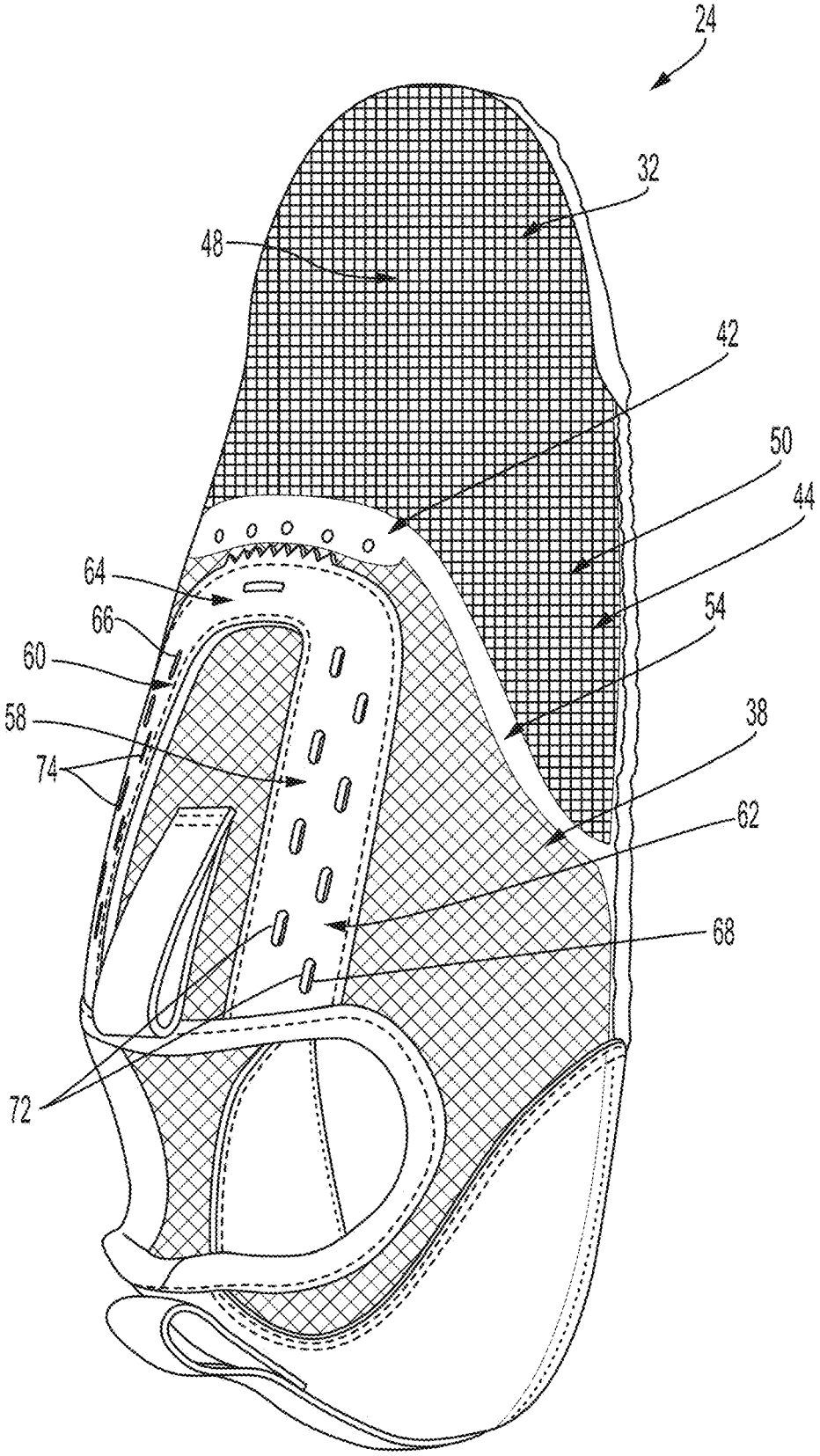
FIG. 5 is a perspective view of an upper of the shoe shown in FIG. 1.
Figure 6:
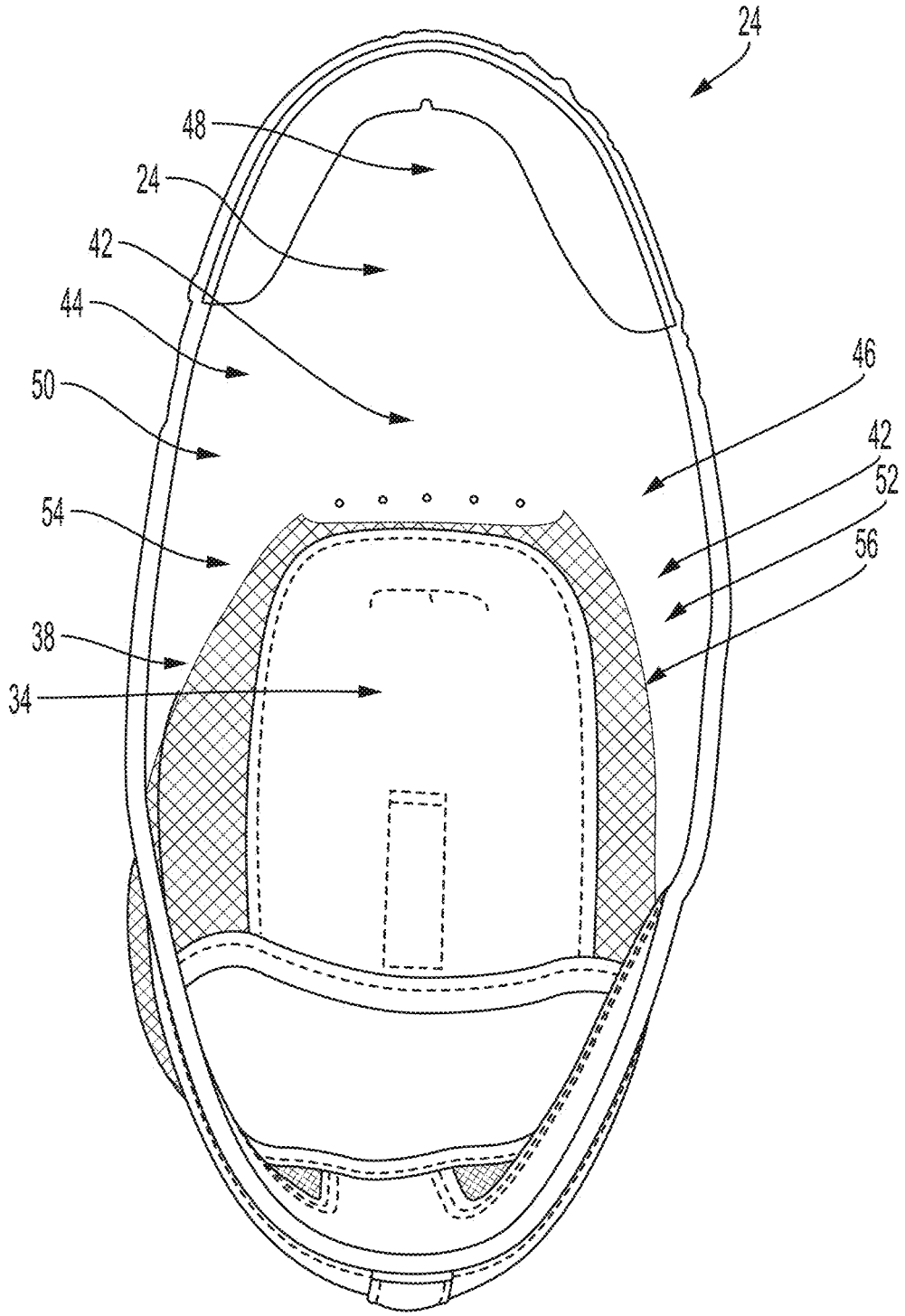
FIG. 6 is a bottom view of the upper shown in FIG. 5.
Figure 7:
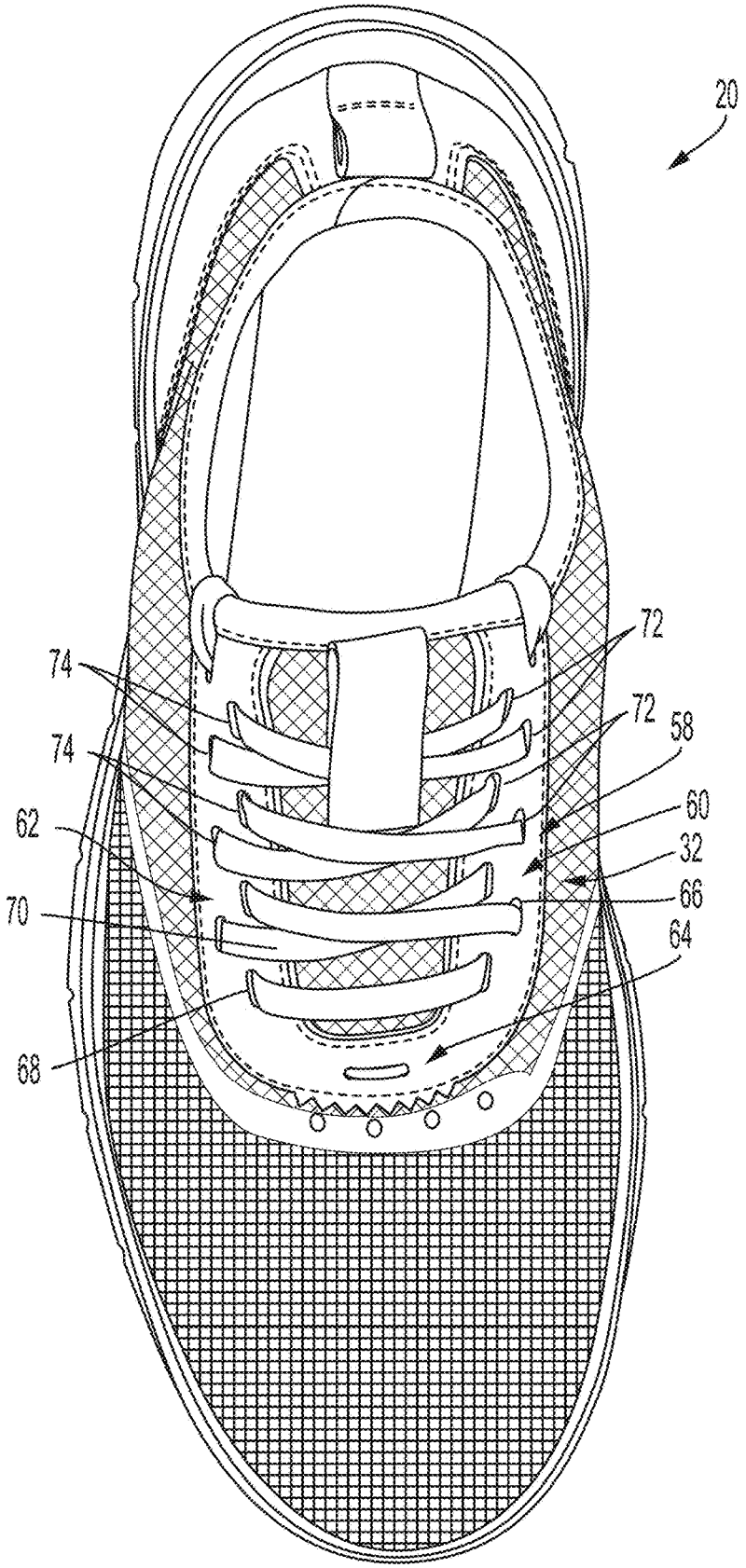
FIG. 7 is a top view of the shoe shown in FIG. 1 further including a shoelace.

An embodiment of a shoe in accordance with the present disclosure is indicated by reference numeral 20 in FIGS. 1-7. The shoe 20 includes a sole, generally indicated at 22, an upper, generally indicated at 24, and a chassis member, generally indicated at 26. The sole 22 and chassis member 26 are secured to the upper 24. The shoe 20 extends forward from a heel end 28 to a toe end 30. The upper 24 has a knitted element 32. In alternative embodiments, the upper 24 is constructed of fabric and/or other materials and may or may not be of a unitary construction.

The knitted element 32 is formed of a unitary one-piece construction during a knitting process on a knitting machine. The knitted element 32 includes a knitted upper throat region 34, a knitted upper heel region 36, a knitted upper lateral midfoot region 38, a knitted upper medial midfoot region 40, a knitted upper metatarsal region 42, a knitted upper lateral ball region 44, a knitted upper medial ball region 46, and a knitted upper toe region 48. The upper metatarsal region 42 includes a knitted upper lateral metatarsal region 50 and a knitted upper medial metatarsal region 52. The upper has a knitted upper lateral side region 54 and a knitted upper medial side region 56. The upper lateral side region 54 includes the upper lateral midfoot region 38, the upper lateral metatarsal region 50, and the upper lateral ball region 44. The upper medial side region 56 includes the upper medial midfoot region 40, the upper medial metatarsal region 52, and the upper medial ball region 46. The upper toe region 48 is seamlessly knitted with the upper medial and lateral ball regions 46, 44 during the knitting process. The upper medial and lateral ball regions 46, 44 are seamlessly knitted with the upper metatarsal region 42 during the knitting process. The upper metatarsal region 42 is seamlessly knitted with the upper lateral and medial midfoot regions 38, 40 during the knitting process. The knitted upper throat region 34 is seamlessly knitted with (1) the knitted upper toe region 48; (2) the knitted upper lateral side region 54; and (3) the knitted upper medial side region 56. The seamless knitting of the various regions provides a bootie like construction and including an integrated tongue. In alternative embodiments, the upper 24 has a tongue that is not integrated (e.g., the tongue is attached to the upper about a toeward side and is free along at least a portion of a medial side and at least a portion of a lateral side).

The shoe 20 includes a lacing system 58. The lacing system 58 comprising a medial side eyestay 60 and a lateral side eyestay 62. The medial side eyestay 60 and the lateral side eyestay 62 are joined by a transverse portion 64 of the lacking system 58. In alternative embodiments, the medial side eyestay 60 and the lateral side eyestay 62 are separated. The medial side eyestay 60 includes a plurality of medial side eyelets 66, and the lateral side eyestay 62 includes a plurality of lateral side eyelets 68. The eyelets 66, 68 may be openings (e.g., in a tear resistant material such as leather), may be partially defined by grommets coupled to the upper 24, or may be other suitable openings adapted and configured to receive a shoelace. The medial 60 and lateral eyestays 62 are configured such that a single shoelace 70 can be placed through each of the plurality of lateral 68 and medial side eyelets 66 without extending through the knitted element 32. The shoelace 70 is threaded through the medial side eyelets 66 and the lateral side eyelets 68 such that the shoelace overlies the knitted element 32 without passing through the knitted element.

To provide for this lacing configuration, the medial side eyelets 66 include a plurality of medial eyelet pairs 72. Each eyelet of the medial eyelet pair 72 is spaced apart transversely and spaced apart longitudinally. The shoelace 70 enters the medial eyestay 60 through one eyelet of the medial eyelet pair 72 and exits through the other eyelet of the medial eyelet pair. Each eyelet pair 72 of the plurality of medial eyelet pairs is spaced apart longitudinally. The lateral side eyelets 68 include a plurality of lateral eyelet pairs 74. Each eyelet of the lateral eyelet pair 74 is spaced apart transversely and spaced apart longitudinally. The shoelace 70 enters the lateral eyestay 62 through one eyelet of the lateral eyelet pair 74 and exits through the other eyelet of the lateral eyelet pair. Each eyelet pair 74 of the plurality of lateral eyelet pairs is spaced apart longitudinally.

The medial side eyelets 66 do not overlap longitudinally. For example, the two eyelets in the medial eyelet pair 72 are spaced longitudinally from each other. In alternative embodiments, adjacent medial eyelets 66 may overlap longitudinally while being spaced transversely. The same is true for the lateral side eyelets 68. In some embodiments, each medial side eyelet 66 is substantially similar in size, and the medial eyelets of each medial eyelet pair 72 are spaced apart longitudinally by a length substantially equal to a longitudinal length of one of medial side eyelets 66. In alternative embodiments, the spacing may be greater than a single length of the one medial side eyelet 66. The same is true for the lateral side eyelets 68 and lateral side eyelet pairs 74.

The medial eyestay 60 and the lateral eyestay 62, along with the transverse portion 64, form a U-shaped panel. The panel has an interior edge margin 76 and an exterior edge margin 78. The interior edge margin 76 faces a centerline of the upper, and the exterior edge margin 78 faces away from the centerline of the upper. The panel is stitched to the knitted element 32 in the exterior edge margin 78. In some embodiments, the panel is also stitched to the knitted element 32 in the interior edge margin 76.

The eyelets 66, 68 and the shoelace 70 are positioned such that the shoelace 70 partially overlies the medial eyestay 60, and the medial eyestay partially overlies the shoelace. The shoelace 70 also partially overlies the lateral eyestay 62, and the lateral eyestay partially overlies the shoelace. The shoelace 70 overlies the inner edge margin 76 of the medial eyestay 60, and the shoelace overlies the inner edge margin of the lateral eyestay 62. The inner edge margin 76 of the medial eyestay 60 does not overlap the shoelace 70, and the inner edge margin of the lateral eyestay 62 does not overlap the shoelace.

The depicted embodiment illustrates the shoe 20 with a knitted upper 24 and leather medial 60 and lateral eyestays 62. In alternative embodiments not depicted, the materials of the shoe 20 may differ. For example, and without limitation, the upper 24 may be fabric, polymer, leather, or the like (of unitary or dispersate construction). The medial 60 and lateral eyestays 62 may be fabric, polymer, knitted, or the like.

In view of the foregoing, it should be appreciated that the shoe of the disclosure has several advantages over the prior art.

As various modifications could be made in the constructions and methods herein described and illustrated without departing from the scope of the disclosure, it is intended that all matter contained in the foregoing description or shown in the accompanying drawings shall be interpreted as illustrative rather than limiting. For example, the wedge shoe may be any type of wedge shoe, such as a wedge sandal, a wedge pump, an open-toe wedge, a platform wedge, etc. Thus, the breadth and scope of the present disclosure should not be limited by any of the above-described exemplary embodiments, but should be defined only in accordance with the following claims appended hereto and their equivalents It should also be understood that when introducing elements in the present disclosure in the claims or in the above description of exemplary embodiments of the disclosure, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

What is claimed is:

1. A shoe comprising:

a knitted shoe upper comprising a knitted element, the knitted element being formed of a unitary one-piece construction during a knitting process on a knitting machine, the knitted element comprising a knitted upper throat region, a knitted upper heel region, a knitted upper lateral midfoot region, a knitted upper medial midfoot region, a knitted upper metatarsal region, a knitted upper lateral ball region, a knitted upper medial ball region, and a knitted upper toe region, the knitted upper metatarsal region including a knitted upper lateral metatarsal region and a knitted upper medial metatarsal region, the knitted upper having a knitted upper lateral side region and a knitted upper medial side region, the knitted upper lateral side region including the knitted upper lateral midfoot region, the knitted upper lateral metatarsal region and the knitted upper lateral ball region, the knitted upper medial side region including the knitted upper medial midfoot region, the knitted upper medial metatarsal region and the knitted upper medial ball region, the knitted upper throat region constituting a throat region of the knitted upper, the knitted upper heel region constituting a heel region of the knitted upper, the knitted upper toe region constituting a toe region of the knitted upper, the knitted upper toe region being seamlessly knitted with the knitted upper medial and lateral ball regions during the knitting process, the knitted upper medial and lateral ball regions being seamlessly knitted with the knitted upper metatarsal region during the knitting process, the knitted upper metatarsal region being seamlessly knitted with the knitted upper lateral and medial midfoot regions during the knitting process, the knitted upper throat region being seamlessly knitted with the knitted upper toe region, the knitted upper throat region being seamlessly knitted with the knitted upper lateral side region, the knitted upper throat region being seamlessly knitted with the knitted upper medial side region, the knitted upper throat region being seamlessly knitted with the knitted upper lateral and medial side regions such that the knitted upper is of a tongueless construction; and a lacing system comprising a shoelace, a medial side eyestay and a lateral side eyestay, the medial side eyestay being adjacent the knitted upper throat region and adjacent the knitted upper medial side region, the medial side eyestay including a plurality of medial side eyelets, the lateral side eyestay being adjacent the knitted upper throat region and adjacent the knitted upper lateral side region, the lateral side eyestay including a plurality of lateral side eyelets, the medial eyestay and the lateral eyestay being spaced from one another, the medial eyestay and the lateral eyestay both extending longitudinally between an ankle opening and the knitted upper toe region, the medial eyestay having an interior edge margin and an exterior edge margin, the interior edge margin facing a centerline of the knitted upper, the exterior edge margin facing away from the centerline of the knitted upper, the medial eyestay being stitched to the knitted element in the exterior edge margin and in the interior edge margin, the lateral eyestay having an interior edge margin and an exterior edge margin, the interior edge margin facing a centerline of the knitted upper, the exterior edge margin facing away from the centerline of the knitted upper, the lateral eyestay being stitched to the knitted element in the exterior edge margin and in the interior edge margin, the plurality of medial side eyelets comprising a plurality of medial eyelet pairs, each eyelet of each medial eyelet pair being spaced both transversely and longitudinally from the corresponding other eyelet of the medial eyelet pair, each eyelet pair of the plurality of medial eyelet pairs being spaced apart longitudinally, the plurality of lateral side eyelets comprising a plurality of lateral eyelet pairs, each eyelet of each lateral eyelet pair being spaced both transversely and longitudinally from the corresponding other eyelet of the lateral eyelet pair, each eyelet pair of the plurality of lateral eyelet pairs being spaced apart longitudinally, the shoelace being threaded through and spanning both eyelets of a first pair of the medial eyelet pairs such that the portion of the shoelace spanning the eyelets of the first pair of the medial eyelet pairs is covered by the medial side eyestay and is sandwiched between the medial side eyestay and the knitted element, the portion of the shoelace spanning the eyelets of the first pair of the medial eyelet pairs not extending through the knitted element, the shoelace being threaded through and spanning both eyelets of a first pair of the lateral eyelet pairs such that the portion of the shoelace spanning the eyelets of the first pair of the lateral eyelet pairs is covered by the lateral side eyestay and is sandwiched between the lateral side eyestay and the knitted element, the portion of the shoelace spanning the eyelets of the first pair of the lateral eyelet pairs not extending through the knitted element.

2. The shoe as set forth in claim 1, wherein the plurality of medial side eyelets do not overlap longitudinally.

3. The shoe as set forth in claim 2, wherein the plurality of lateral side eyelets do not overlap longitudinally.

4. The shoe as set forth in claim 1, wherein each medial side eyelet is similar in size, and wherein the medial side eyelets of each medial eyelet pair are spaced apart longitudinally by a length substantially equal to a longitudinal length of one of the medial side eyelets.

5. The shoe as set forth in claim 4, wherein each lateral side eyelet is similar in size, and wherein the lateral side eyelets of each lateral eyelet pair are spaced apart longitudinally by a length substantially equal to a longitudinal length of one of lateral side eyelets.

6. The shoe as set forth in claim 1, wherein the medial and lateral eyelets comprise grommets.

7. The shoe as set forth in claim 1, wherein the medial side eyestay and the lateral side eyestay comprise a non-knitted material.

8. The shoe as set forth in claim 1, wherein the medial side eyestay and the lateral side eyestay comprise leather.

9. The shoe as set forth in claim 1, wherein the plurality of medial side eyelets and the plurality of lateral side eyelets are longer longitudinally than transversely.

10. The shoe as set forth in claim 1, wherein the medial side eyestay and the lateral side eyestay differ in material from the knitted upper throat region and the knitted upper medial and lateral side regions.

11. A shoe comprising:

a knitted shoe upper comprising a knitted element, the knitted element being formed of a unitary one-piece construction during a knitting process on a knitting machine, the knitted element comprising a knitted upper throat region, a knitted upper heel region, a knitted upper lateral midfoot region, a knitted upper medial midfoot region, a knitted upper metatarsal region, a knitted upper lateral ball region, a knitted upper medial ball region, and a knitted upper toe region, the knitted upper metatarsal region including a knitted upper lateral metatarsal region and a knitted upper medial metatarsal region, the knitted upper having a knitted upper lateral side region and a knitted upper medial side region, the knitted upper lateral side region including the knitted upper lateral midfoot region, the knitted upper lateral metatarsal region and the knitted upper lateral ball region, the knitted upper medial side region including the knitted upper medial midfoot region, the knitted upper medial metatarsal region and the knitted upper medial ball region, the knitted upper throat region constituting a throat region of the knitted upper, the knitted upper heel region constituting a heel region of the knitted upper, the knitted upper toe region constituting a toe region of the knitted upper, the knitted upper toe region being seamlessly knitted with the knitted upper medial and lateral ball regions during the knitting process, the knitted upper medial and lateral ball regions being seamlessly knitted with the knitted upper metatarsal region during the knitting process, the knitted upper metatarsal region being seamlessly knitted with the knitted upper lateral and medial midfoot regions during the knitting process, the knitted upper throat region being seamlessly knitted with the knitted upper toe region, the knitted upper-throat region being seamlessly knitted with the knitted upper lateral side region, the knitted upper-throat region being seamlessly knitted with the knitted upper medial side region, the upper knitted throat region being seamlessly knitted with the knitted upper lateral and medial side regions such that the knitted upper is of a tongueless construction; and a lacing system comprising a shoelace, a medial side eyestay and a lateral side eyestay, the medial side eyestay including a plurality of medial side eyelets and the lateral side eyestay including a plurality of lateral side eyelets, the medial side eyestay extending transversely between an inner edge and an outer edge, the inner edge being closer to a longitudinal centerline of the knitted upper than the outer edge, the medial side eyestay having an inner edge margin adjacent the inner edge and having an outer edge margin adjacent the outer edge, the lateral side eyestay extending transversely between an inner edge and an outer edge, the inner edge being closer to a longitudinal centerline of the knitted upper than the outer edge, the lateral side eyestay having an inner edge margin adjacent the inner edge and having an outer edge margin adjacent the outer edge, wherein the medial and lateral eyestays collectively do not overlie the entirety of the knitted upper throat region, the medial eyestay being stitched to the knitted element along the inner edge margin of the medial eyestay, the medial eyestay being stitched to the knitted element along the outer edge margin of the medial eyestay, the lateral eyestay being stitched to the knitted element along the inner edge margin of the lateral eyestay, the lateral eyestay being stitched to the knitted element along the outer edge margin of the lateral eyestay; and the plurality of medial side eyelets comprising a plurality of medial eyelet pairs, the plurality of lateral side eyelets comprising a plurality of lateral eyelet pairs, the shoelace being threaded through and spanning both eyelets of a first pair of the medial eyelet pairs such that the portion of the shoelace spanning the eyelets of the first pair of the medial eyelet pairs is covered by the medial side eyestay and is sandwiched between the medial side eyestay and the knitted element, the portion of the shoelace spanning the eyelets of the first pair of the medial eyelet pairs not extending through the knitted element, the shoelace being threaded through and spanning both eyelets of a first pair of the lateral eyelet pairs such that the portion of the shoelace spanning the eyelets of the first pair of the lateral eyelet pairs is covered by the lateral side eyestay and is sandwiched between the lateral side eyestay and the knitted element, the portion of the shoelace spanning the eyelets of the first pair of the lateral eyelet pairs not extending through the knitted element.

12. The shoe as set forth in claim 11, wherein the shoelace partially overlies the medial eyestay and the medial eyestay partially overlies the shoelace, and therein the shoelace partially overlies the lateral eyestay and the lateral eyestay partially overlies the shoelace.

13. The shoe as set forth in claim 12, wherein the shoelace overlies the inner edge margin of the medial eyestay, and wherein the shoelace overlies the inner edge margin of the lateral eyestay.

14. The shoe as set forth in claim 12, wherein the inner edge margin of the medial eyestay does not overlap the shoelace, and wherein the inner edge margin of the lateral eyestay does not overlap the shoelace.

* * * * *